US006812891B2

(12) United States Patent
Montgomery et al.

(10) Patent No.: US 6,812,891 B2
(45) Date of Patent: Nov. 2, 2004

(54) TRI-BAND MULTI-MODE ANTENNA

(75) Inventors: Mark Montgomery, Melbourne Beach, FL (US); Chris McCue, Melbourne, FL (US); Jason M. Hendler, Indian Harbour Beach, FL (US); Frank M. Caimi, Vero Beach, FL (US)

(73) Assignee: SkyCross, Inc., Melbourne, FL (US)

( * ) Notice: Subject to any disclaimer, the term of this patent is extended or adjusted under 35 U.S.C. 154(b) by 0 days.

(21) Appl. No.: 10/289,617

(22) Filed: Nov. 7, 2002

(65) Prior Publication Data

US 2004/0090367 A1 May 13, 2004

(51) Int. Cl.[7] ..... H01Q 1/38
(52) U.S. Cl. ..... 343/700 MS; 343/702
(58) Field of Search ..... 343/700 MS, 846, 343/830, 853, 829, 845, 725, 769, 789, 752

(56) References Cited

U.S. PATENT DOCUMENTS 4,847,625 A 7/1989 Dietrich et al.
5,406,233 A 4/1995 Shih et al.
5,497,164 A 3/1996 Croq
5,539,418 A * 7/1996 Egashira et al. ..... 343/712
6,166,694 A 12/2000 Ying
6,215,229 B1 4/2001 Kuroda et al.
6,232,923 B1 5/2001 Guinn et al.
6,639,558 B2 * 10/2003 Kellerman et al. .. 343/700 MS

* cited by examiner

*Primary Examiner*—James Vannucci
(74) *Attorney, Agent, or Firm*—John L. DeAngelis, Jr.; Beusse Brownlee Wolter Mora & Maire, P.A.

(57) ABSTRACT

An antenna resonant in two or more frequency bands. The antenna comprises three parallel conductive plates disposed in a stacked orientation, with a first dielectric layer interposed between the bottom and the middle conductive plates and a second dielectric layer interposed between the middle and the top conductive plates. The middle conductive plate is smaller than the bottom and top conductive plates. A signal feed is connected to the top and the middle conductive plates; a first shorting pin is connected between the bottom and top conductive plates and a second shorting pin is connected between the middle and the bottom conductive plate.

9 Claims, 2 Drawing Sheets

TRI-BAND MULTI-MODE ANTENNA

FIELD OF THE INVENTION

The present invention relates generally to antennas for receiving and transmitting radio frequency signals, and more specifically to such an antenna for receiving and transmitting radio frequency signals in multiple wireless communications frequency bands and with various radiation patterns.

BACKGROUND OF THE INVENTION

With the expansive deployment of computer resources, it has become advantageous to connect computers to allow collaborative sharing of information. Conventionally, the connection is in the form of wired computer or data networks (generally referred to as local area networks or LAN's) operating under various standard protocols, such as the Ethernet protocol. Users connected to the network can exchange data with other network users, irrespective of the physical distance between, the users. These networks, which have become ubiquitous among computer users, operate at fairly high speeds, up to about 1 Gbps, using relatively inexpensive hardware. However, LANs are limited to the physical, hard-wired infrastructure of the structure in which the users are located.

During recent years, the market for wireless communications of all types has enjoyed tremendous growth. Wireless technology allows people to exchange information using pagers, cellular telephones, and other wireless communication products. With the steady expansion of wireless communications, wireless concepts are now being applied to data networks, relieving the user of the need for a wired connection between the computer and the network.

The major motivation and benefit from wireless LANs is the user's increased mobility. Untethered from conventional network connections, network users can access the LAN from wireless network access points strategically located within a structure or on a campus. Examples of the practical uses for wireless network access are limited only by the imagination of the application designer. Medical professionals can obtain not only patient records, but real-time vital signs and other reference data at the patient bedside without relying on reams of paper charts and physical paper. From anywhere on the factory floor, workers can access part and process specifications without impractical or impossible wired network connections. Wireless connections with real-time sensing allow a remote engineer to diagnose and maintain the health and welfare of manufacturing equipment. Warehouse inventories can be verified quickly and effectively with wireless scanners connected to the main inventory database. Frequently it is more economical to install a wireless LAN than to install a wired network in an existing structure. Wireless LANs offer the connectivity and the convenience of wired LANs without the need for expensive wiring or rewiring.

The Institute for Electrical and Electronics Engineers (IEEE) standard for wireless LANs (IEEE 802.11) sets forth two different wireless network configurations: ad-hoc and infrastructure. In the ad-hoc network, computers are brought together to form a network "on the fly." There is no structure to the network and there are no fixed network points. Typically, every node is able to communicate with every other node. The infrastructure wireless network uses fixed wireless network access points with which mobile nodes can communicate. These wireless network access points are typically bridged to landlines to allow users to access other networks and sites not on the wireless network.

The IEEE 802.11 standard governs both the physical (PHY) and medium access control (MAC) layers of the network. The PHY layer, which actually handles the transmission of data between nodes, can use either direct sequence spread spectrum, frequency-hopping spread spectrum, or infrared (IR) pulse position modulation. IEEE 802.11 makes provisions for data rates of either 1 Mbps or 2 Mbps, and calls for operation in the 2.4–2.4835 GHz frequency band (which is an unlicensed band for industrial, scientific, and medical (ISM) applications) and 300–428,000 GHz for IR transmission.

The MAC layer comprises a set of protocols that maintain order among the users accessing the network. The 802.11 standard specifies a carrier sense multiple access with collision avoidance (CSMA/CA) protocol. In this protocol, when a node receives a packet for transmission over the network, it first listens to ensure no other node is transmitting. If the channel is clear, the node transmits the packet. Otherwise, the node chooses a random "backoff factor" that determines the amount of time the node must wait until it is allowed to retry the transmission.

Several extensions of the IEEE 802.11 standard have been developed. The first, referred to as 802.11a, provides a data rate of up to 54 Mbps in the 5 GHz frequency band. The 802.11a standard requires an orthogonal frequency division multiplexing encoding scheme, rather than the frequency hopping and direct sequence spread schemes of 802.11. The 802.11b standard (also referred to as 802.11 high rate or Wi-Fi) provides a 11 Mbps transmission data rate, with a fallback to data rates of 5.5, 2 and 1 Mbps. The 802.11b scheme uses the 2.4 GHz frequency band, using direct sequence spread spectrum signalling. Thus 802.11b provides wireless functionality comparable to the Ethernet protocol. The newest standard, 802.11g provides for a data rate of 20+Mbps in the 2.4 GHz band. A primarily European wireless networking standard similar to the 802.11 standards, referred to as HyperLAN2, operates at 5.8 MHz.

Today, devices implementing either the 802.11a or 802.11b standard are available. The higher data rate of 802.11a devices can support bandwidth hungry applications, but the higher operating frequency limits the radio range of the transmitting and receiving units. Typically, 802.11a compliant radios can deliver 54 Mbps at distances of about 60 feet, which is far less than the 300 feet radio range over which the 802.11b systems can operate, albeit at lower data rates. Thus 802.11a installations require a larger number of media access points from which users link into the network.

Recognizing the advantages and disadvantages of the two standards, the current market trend is to develop dual mode communications devices that take advantage of the 802.11a protocol, but provide for a fall back mode at the lower data rates of the 802.11b systems when an adequate communications link cannot be established under the 802.11a standard. Software processors in the receiving and transmitting units can accommodate operation under either standard.

According to the prior art, such dual-mode devices use either a single broadband antenna or multiple single-band antennas. No effective multiple or dual band antennas are available. The known broadband antennas capable of operating in both the 802.11a and 802.11b frequency bands represent poor choices due to their high gain at frequencies outside the 802.11a and 802.11b operational bands. The wide bandwidth allows extraneous noise and interfering signals to enter the transmitter/receiver, degrading the signal-to-noise ratio and limiting the data rate. Thus the wide bandwidth imposes more restrictive requirements on the radio frequency filters. Use of multiple single-band antennas requires complex and space-hungry feed and switching structures for multiple band operation, as each antenna requires a dedicated feed network. Since it is generally required to fit the antenna into a small space within the communications device, space it as a premium and thus multiple single-band antennas are not preferred.

BRIEF SUMMARY OF THE INVENTION

The present invention comprises a plurality of layers in stacked relation, including a lower conductive plate, a middle conductive plate, an upper conductive plate, a lower dielectric layer disposed between the lower conductive plate and the middle conductive plate and an upper dielectric layer disposed between the middle conductive plate and the upper conductive plate. The antenna further comprises a first ground conductor extending between and electrically connected to the upper conductive plate and the lower conductive plate, a second ground conductor extending between and electrically connected to the middle conductive plate and the lower conductive plate, and a signal feed conductor connected to the upper conductive plate. The antenna advantageously presents a resonance condition in several frequency bands.

BRIEF DESCRIPTION OF THE DRAWINGS

The foregoing and other features of the invention will become apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
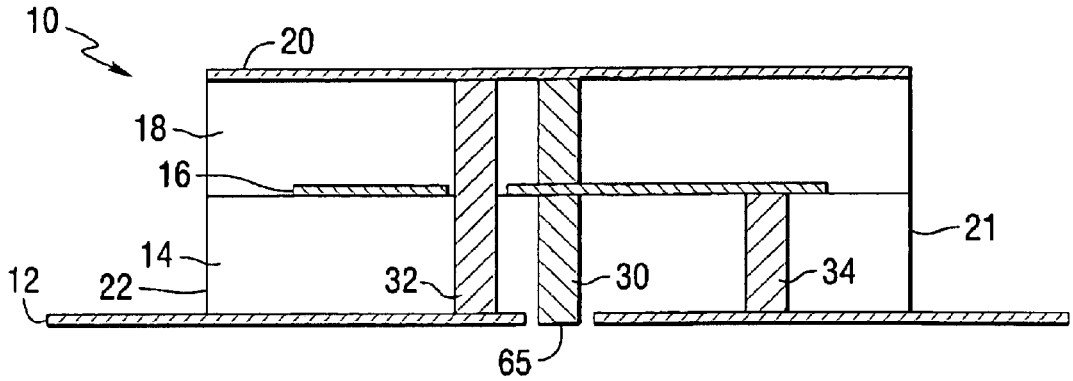
FIG. 1 is a side view cross-section of an antenna constructed according to the teachings of the present invention.

Before describing in detail the particular antenna in accordance with the present invention, it should be observed that the present invention resides primarily in a novel combination of hardware elements. Accordingly, the hardware elements have been represented by conventional elements in the drawings, showing only those specific details that are pertinent to the present invention, so as not to obscure the disclosure with structural details that will be readily apparent to those skilled in the art having the benefit of the description herein.

A tri-band, single and multi-mode antenna 10 constructed according to the teachings of the present invention is illustrated in FIG. 1. The antenna 10 comprises, in stacked relation a bottom conductive plate 12 operative as a ground plane, a dielectric substrate 14, a middle conductive plate 16, a dielectric substrate 18 and a top conductive plate 20. Although the ground plane 12 is shown as extending beyond lateral edges 21 and 22 of the dielectric substrates 14 and 18, this is not necessarily required. In one embodiment the middle conductive plate 16 is smaller than the upper conductive plate 20. The relationships among the sizes of the upper, middle and lower conductive plates can be modified to produce the desired antenna performance parameters, such as the resonant frequency. The conductive plates 12, 14 and 16 are disposed in a substantially parallel orientation.

The antenna 10 further comprises a conductive signal via 30 electrically connected to the top conductive plate 20 and the middle conductive plate 16. As shown, the signal via 30 is not electrically connected to the bottom conductive plate 12. A shorting conductive via or ground pin 32 is positioned proximate the signal via 30 for interconnecting the top conductive plate 20 and the bottom conductive plate 12. A shorting conductive via or ground pin 34 is positioned in a spaced apart relation from the signal via 30 for interconnecting the middle conductive plate 16 and the bottom conductive plate 12.

A signal is supplied to the antenna 10 via the signal via 30 when operating in the transmitting mode and a signal is output from the signal via 30 in the receiving mode.

Preferably, the signal via 30 is positioned at the approximate center of the top conductive plate 20. The ground pins (or vias) 32 and 34 are positioned (both with respect to each other and with respect to the other elements of the antenna 10) to achieve the desired antenna operational characteristics. Preferably, the distance between the ground pin 34 and the signal via 30 is greater than the distance between the ground pin 32 and the signal via 30.

The interconnection between the top conductive plate 20 and the bottom conductive plate 12 as provided by the ground pin 32, establishes an interaction between the top conductive plate 20 and the bottom conductive plate 12 such that the antenna 10 resonates at about 2.45 GHz. As discussed above, this is the operational frequency for 802.11b communications devices. In this mode, the current flows substantially through the ground pin 32 and thus the antenna pattern is omni-directional. With most of the radiation radiated from the lateral surfaces of the antenna 10, the omni-directional pattern is the familiar donut pattern. This is the so-called monopole mode operation. The signal is polarized in the z-direction with reference to the coordinate system illustrated in FIG. 2.

The interconnection of the middle conductive plate 16 and the bottom conductive plate 12 by the ground pin 34 causes the antenna 10 to be resonant within the 802.11a and the HyperLAN2 frequency bands, that is in the range of about 5.15 to about 5.8 GHz. The current flows primarily along the top conductive plate 20 creating a radiation pattern directed in the elevation direction or toward the zenith. Thus the antenna radiation pattern resembles that of a patch antenna within this frequency band. This is the so-called loop operational mode. The loop-mode signal is polarized in the y-direction with reference to the coordinate system illustrated in FIG. 2.

Figure 2:
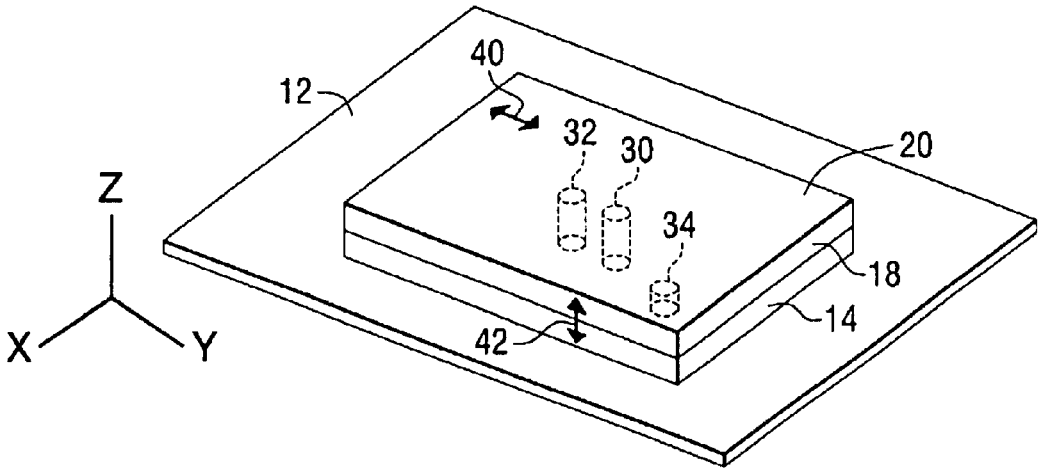
FIG. 2 is a perspective view of an antenna constructed according to the teachings of the present invention.

FIG. 2 is a perspective view of the antenna 10 illustrating the various elements shown in FIG. 1. The arrowheads 40 indicate the current flow in the top conductive plate 12 during operation in the 2 GHz range. The arrowheads 42 indicate current flow through the ground pin 34 during operation in the 5 GHz band. According to the teachings of the present invention, the vertical axes of the conductive signal via 30, the shorting conductive via or ground pin 32 and the shorting conductive via or ground pin 34 are not necessarily co planar, as illustrated.

Figure 3:
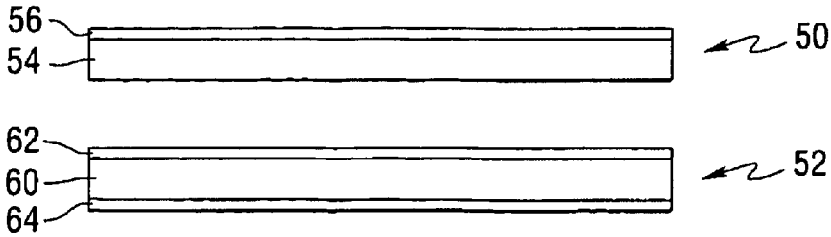
FIG. 3 illustrates the constituent material layers of an antenna constructed according to the teachings of the present invention.

In one embodiment, the antenna 10 is formed from two material layers 50 and 52 illustrated in FIG. 3. The material layer 50 comprises a dielectric layer 54 and an upper conductive layer 56. The material layer 52 comprises a dielectric layer 60 between an upper conductive layer 62 and a lower conductive layer 64. The material layers 50 and 52 are bonded together such that the upper conductive layer 56 forms the top conductive plate 20, the upper conductive layer 62 forms the middle conductive plate 16 and the bottom conductive layer 64 forms the bottom conductive plate 12.

Advantageously, fabrication of the antenna 10 follows conventional printed circuit board fabrication techniques. The upper conductive layers 56 and 62 and the lower conductive layer 64 are masked, patterned, etched and drilled as required to form the various conductive plates and the holes for the conductive vias of the antenna 10. A prepregnated adhesive layer (not shown in FIG. 3) can then be used to bond the material layers 50 and 52.

After bonding, the holes are plated to form the signal via 30 and the ground pins 32 and 34. Since the upper conductive layer 56 and the lower conductive layer 64 are exposed after bonding, these can be etched at this time to form the top and bottom conductive plates 20 and 12, respectively.

In one embodiment the antenna 10, excluding the ground plane 12, is about 740 mils square. The signal via 30 is positioned approximately in the center of the antenna 10. The distance between the signal via 30 and the ground pin 32 is about 0.115 inches and the distance between the signal via 30 and the ground pin 34 is about 0.125 inches.

In an embodiment where the antenna is surface mounted on a printed circuit board, solder mask material is applied to the bottom conductive plate 12 and the bottom surface 65 (see FIG. 1) of the signal via 30. The signal via 30 mates with and is soldered to a printed circuit board trace carrying the signal to or from the antenna 10. Similarly, the bottom conductive plate 12 mates with and is soldered to a ground trace on the printed circuit board.

The design attributes of the antenna 10 described above allow assembly onto a mother board using the same pick, place and reflow solder techniques that are used for other mother board components. Considerable manufacturing savings thus accrue to the mother board manufacturer, as the hand soldering of connectors and cable assemblies according to the prior art is avoided.

Figure 4:
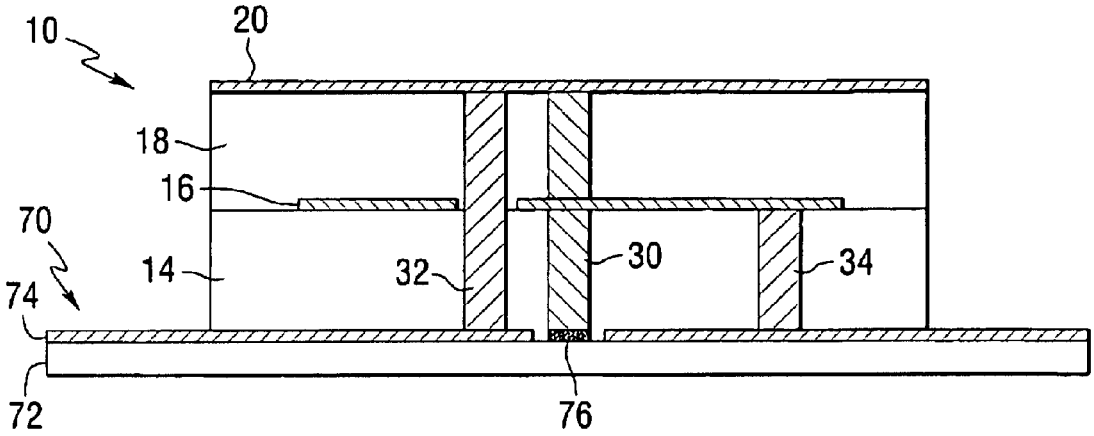
FIG. 4 illustrates a second embodiment of an antenna constructed according to the teachings of the present invention.

In a connector embodiment of the antenna 10, illustrated in FIG. 4, a substrate 70 comprises a dielectric layer 72, a ground plane 74 and a signal trace 76, which is electrically connected to the signal via 30. As shown, the ground plane 74 is insulated from the signal trace 76. The ground pins 32 and 34 are electrically connected to the ground plane 74. A cable connector (not shown) comprises a signal pin electrically connected to the signal trace 76 and a ground connector for connection to the ground plane 74. In lieu of a cable connector, a conductive wire can be electrically connected to the signal trace 76 for carrying a signal to and from the antenna 10 via the signal via 30. A second conductor is electrically connected to the ground plane 74.

Figure 5:
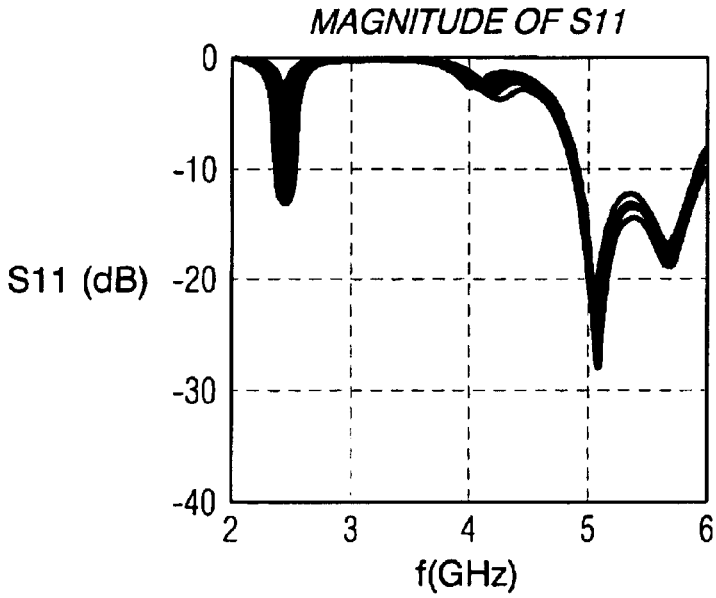
FIG. 5 illustrates the return loss parameter for an antenna constructed according to the teachings of the present invention.

FIG. 5 illustrates the return loss (the s11 parameter) for one embodiment of the antenna constructed according to the teachings of the present invention. As can be see, resonances are presented at about 2.45 GHz and from about 5.1 to about 5.8 GHz. Thus the antenna operates in the 802.11b frequency band and also in the 802.11a and HyperLAN2 frequency bands.

Although the antenna of the present invention has been described with respect to operation in the IEEE 802.11a and b and the HyperLAN2 frequency bands, the invention is not so limited. The teachings of the present invention can be applied to an antenna capable of operation in other frequency bands. For example, the antenna dimensions can be simply scaled up for operation at a commensurately lower frequency or scaled down for operation at a commensurately higher frequency. Reducing the dimensions by a factor of two doubles the resonant frequency. Also, the distance between the signal via 30 and one or both of the ground pins 32 and 34 can be changed to alter the antenna performance characteristics, including the resonant frequency. The distance between the conductive plate 12, the middle conductive plate 16 and the top conductive plate 20 can be modified to affect the performance parameters.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. For example, the feature dimensions and shapes of the various antennas described herein can be modified to permit operation in various frequency bands with various bandwidths. In addition, modifications may be made to adapt a particular situation to the teachings of the present invention without departing from its essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An antenna comprising:

a lower conductive plate;

a middle conductive plate;

an upper conductive plate;

a lower dielectric layer disposed between the lower conductive plate and the middle conductive plate;

an upper dielectric layer disposed between the middle conductive plate and the upper conductive plate;

a first shorting pin extending between and electrically connected to the upper conductive plate and the lower conductive plate and passing through an opening in the middle conductive plate;

a second shorting pin extending between and electrically connected to the middle conductive plate and the lower conductive plate; and a single signal feed conductor extending from the upper conductive plate to the lower conductive plate, wherein the signal feed conductor is electrically connected to the upper conductive plate and the middle conductive plate.

2. The antenna of claim 1 wherein the lower conductive plate comprises a ground plane.

3. The antenna of claim of 2 wherein the ground plane extends beyond the lateral edges of the upper and the lower dielectric layers.

4. The antenna of claim 1 wherein an area of the middle conductive plate is less than the area of the upper conductive plate.

5. The antenna of claim 1 wherein the first and the second shorting pins and the signal feed conductor comprise conductive vias.

6. The antenna of claim 1 wherein the antenna presents a resonant condition within a first frequency band due to the interaction between the top and the bottom conductive plates.

7. The antenna of claim 6 wherein the first frequency band includes 2.45 GHz.

8. The antenna of claim 1 wherein the antenna presents a resonant condition within a second frequency band due to the interaction between the top, middle and bottom conductive plates.

9. The antenna of claim 8 wherein the second frequency band includes the frequency range of between about 5 GHz to 6 GHz.

* * * * *